US009144327B2

(12) United States Patent
Bryce

(10) Patent No.: US 9,144,327 B2
(45) Date of Patent: Sep. 29, 2015

(54) REFRIGERATED DISPLAY CABINET

(76) Inventor: Alasdair James Bryce, Ilkley (GB)

( * ) Notice: Subject to any disclaimer, the term of this patent is extended or adjusted under 35 U.S.C. 154(b) by 461 days.

(21) Appl. No.: 13/543,915

(22) Filed: Jul. 9, 2012

(65) Prior Publication Data

US 2013/0019625 A1 Jan. 24, 2013

(30) Foreign Application Priority Data

Jul. 20, 2011 (GB) ..... 1112450

(51) Int. Cl.
*A47F 3/04* (2006.01)
*A47F 10/06* (2006.01)

(52) U.S. Cl.
CPC ..... *A47F 3/0408* (2013.01); *A47F 10/06* (2013.01)

(58) Field of Classification Search
CPC ..... A47F 3/0408; A47F 10/06
USPC ..... 62/187, 254, 255, 256; 312/265.4
See application file for complete search history.

(56) References Cited

U.S. PATENT DOCUMENTS

| | | | | |
|---|---|---|---|---|
| 2,568,268 | A * | 9/1951 | Booth | 62/285 |
| 4,308,726 | A * | 1/1982 | Perez et al. | 62/256 |
| 6,185,098 | B1 * | 2/2001 | Benavides | 361/695 |
| 6,672,092 | B2 * | 1/2004 | Ruiz et al. | 62/246 |
| 6,742,344 | B2 * | 6/2004 | Vormedal | 62/89 |
| 2002/0005686 | A1 * | 1/2002 | Nuttall et al. | 312/236 |
| 2002/0072323 | A1 * | 6/2002 | Hakemann | 454/233 |

* cited by examiner

*Primary Examiner* — Emmanuel Duke

(57) ABSTRACT

A refrigerated display cabinet having novel door and shelf system configured to minimize any rise in cabinet temperature during door opening. The door and shelf system can have the effect of deflecting refrigerated air into an alternative circulation pattern when doors are open. In this way, cabinet efficiencies are maintained during the time in which the doors are opened.

16 Claims, 10 Drawing Sheets

REFRIGERATED DISPLAY CABINET

CROSS-REFERENCE TO OTHER RELATED APPLICATIONS

This application relates to and claims priority from GB Patent Application Number GB 1112450.0, filed on Jul. 20, 2011, disclosure of which is incorporated herein by reference.

BACKGROUND OF THE INVENTION

1. Field of the Invention

The present invention relates to a refrigerated display cabinet. In particular, but not exclusively, the present invention relates to a refrigerated display cabinet having a housing defining a display chamber, at least one shelf mounted in the chamber for receiving items to be displayed, and a refrigeration system for circulating refrigerated air around the chamber. Refrigerated display cabinets are utilised in retail, catering and convenience establishments for storing chilled food or drinks, and for displaying the food or drink items in an attractive manner.

A wide range of different types of cabinets have been produced, to suit the needs of the various different establishments which utilise them. These include cabinets with open fronts through which food or drink items can be inserted and extracted; cabinets with open fronts through which food or drink items can be extracted and rear surfaces with doors for inserting items into the cabinet; cabinets with closed fronts which can be opened so that food or drink items can be inserted and extracted; and cabinets with closed fronts through which food or drink items can be viewed, the food or drink items inserted and extracted through doors in a rear surface of the cabinet.

In each case, the display cabinets have a housing defining a display chamber, a number of shelves mounted in the chamber for receiving items to be displayed, and a refrigeration system. The refrigeration system circulates air which has been cooled to below ambient room temperature around the chamber, to chill the food and drink items. The cabinet housings are shaped to promote air flow around the chamber, so as to reduce the loss of cooled air to the surrounding environment.

2. Description of the Related Art

Refrigerated display cabinets having front or rear surfaces with doors in them suffer from a particular problem of loss of cooled air. This is because the doors are opened whenever it is required to gain access to the chamber for inserting food or drink items into the display cabinet, and/or to remove food or drink items for purchase or serving, depending upon the design of the cabinet. It has been found that opening a door in a cabinet can cause a significant volume of cooled air to be lost into the surrounding environment, and warmer ambient air to enter. This has three significant disadvantages.

Firstly, when cooled air is lost through the open door, the circulation of cooled air within the chamber is disrupted, with the result that the temperature in the chamber is higher than desired during the time when the door is open. As a consequence, when the door is closed, the refrigeration system has to perform additional work in order to re-cool the air in the chamber to the required level. This leads to high energy usage and thus operating costs.

Secondly, the loss of cooled air into the surrounding environment, and the entry of warmer ambient air, also leads to an increase in the temperature of the air in the chamber. This is a particular problem as the cabinets are frequently used in areas where the ambient air temperature is relatively high. As a result, the temperature of the food or drink items in the cabinet may not be maintained at a sufficiently low level. This can lead to the food or drink items becoming too warm, with the result that they may at least be unpalatable, but that they may also present a danger to health, or may require to be disposed of earlier than would otherwise be the case.

Thirdly, the refrigeration system may include a compressor, which is an expensive component. The compressor functions to compress a coolant which, when it subsequently expands, creates a cooling effect which is utilised to cool the air flowing into the display chamber. The loss of cooled air into the surrounding environment, and the entry of warmer ambient air into the display chamber, results in the compressor having to do additional work to maintain the air in the chamber at the required temperature level. This puts additional strain on the compressor, and reduces its effective life so that it requires more regular maintenance than might otherwise be the case, and possibly early replacement.

These problems are exacerbated in high usage environments, where the doors are frequently being opened and closed. Furthermore, in prior cabinets, the doors have usually been a simple arrangement where the door(s) extend from top to bottom of the chamber, and open by sliding horizontally over one-another, to provide access into the chamber. Other cabinets have utilised simple hinged doors, which pivot about vertical hinge pins. In both cases, the result of this is that air is lost from the chamber when the door(s) are opened, as the chamber is open to the surrounding environment over its entire height. The sliding doors also only provide access to food or drink items on part of a length of the shelf or shelves in the chamber.

BRIEF SUMMARY OF THE INVENTION

It is an object of the present invention to obviate or mitigate at least one of the foregoing disadvantages.

Accordingly, the present invention provides a refrigerated display cabinet comprising: a housing defining a display chamber; a refrigeration system for circulating refrigerated air around the chamber; at least one shelf mounted in the chamber for receiving items to be displayed; and at least one door which can be opened to gain access to the chamber; wherein a primary flow path for refrigerated air is defined within the chamber, the primary flow path extending upwardly towards a top of the chamber along a channel defined between a wall of the cabinet and the at least one shelf; and wherein the at least one door is arranged so that, when it is opened, the channel is obstructed and refrigerated air deflected to flow in a secondary flow path around a lower part of the chamber.

In this way, when the at least one door is opened, refrigerated air which is deflected to flow in the secondary flow path is not lost to the surrounding environment. This provides an enhanced cooling effect of the air in the lower part of the chamber so that, when the at least one door is re-closed and the primary flow path re-established, the air in a remaining part of the chamber is quickly re-cooled to a desired level. This is in spite of the fact that refrigerated air is lost from the remaining part of the chamber into the surrounding environment (and warmer ambient air enters the remaining part of the chamber) during the period when the door is open. The retention of refrigerated air in the lower part of the chamber, and the quick re-cooling of the air in the remaining chamber part, help to reduce energy usage and thus operating costs of the cabinet. It also helps to maintain food or drink items in the chamber at a sufficiently low temperature.

The display cabinet may comprise: a lower door which can be opened to gain access to a lower part of the chamber; and at least one further door, positioned above the lower door, which can be opened to gain access to a further part of the chamber; and wherein the at least one further door is arranged so that, when it is opened, the channel is obstructed and refrigerated air deflected to flow in the secondary flow path around the lower part of the chamber.

The at least one door, and thus the lower door and the at least one further door, may be provided in the front or rear of the housing. The channel may be defined between a front or rear wall of the cabinet and a front or rear of the at least one shelf. The at least one door may define at least part of the wall of the cabinet. The lower door and the at least one further door may together define at least part of the wall of the cabinet.

The cabinet may be arranged such that, when the at least one door is opened, the flow channel is substantially entirely or entirely obstructed, such that the flow of air towards the top of the chamber is substantially entirely or entirely prevented. This facilitates the recirculation of refrigerated air in the lower part of the chamber during the period when the at least one further door is open. In this condition, the air circuit is of a reduced size resulting in a more concentrated chilling effect. The at least one door may be the at least one further door.

The at least one door, optionally the at least one further door, may be arranged so that the door itself obstructs the flow channel when it is open. The at least one door, optionally the at least one further door, may be arranged such that it is moveable between a closed position where it lies substantially parallel with a surface of the housing (or in a vertical plane) and does not obstruct the flow channel, and an open position where at least part of the door extends into the chamber and obstructs the flow channel. The at least one door, optionally the at least one further door, may be pivotally mounted to the housing. The at least one door, optionally the at least one further door, may be arranged such that it is moveable between a closed position where it lies substantially parallel with a front or rear surface of the housing (or in a vertical plane), and an open position in which it extends at a non-parallel angle relative to a surface of the housing. The at least one door, optionally the at least one further door, may be pivotable relative to the housing about pivot points which are positioned so that the door obstructs the flow channel when it is opened. The surface of the housing may be a front or rear surface.

Alternatively, the at least one door, optionally the at least one further door, may be operatively associated with a further component of the cabinet so that, when said door is opened, the further component is caused to obstruct the flow channel. The further component may be moveable from a position where it does not obstruct the flow channel, to a position where it obstructs the flow channel, when said door is opened. The further component may be a barrier member which is moveably mounted to the housing within the chamber. The further component may be a shelf or part of a shelf, which may be moveably mounted to the housing within the chamber so as to move to a position where it obstructs the flow channel when the at least one door is opened. The shelf or part of the shelf may be slidably mounted within the housing. The part of the shelf may be pivotable or slidable within the housing, and may be pivotally or slidably mounted to a remainder or main portion of said shelf.

The lower door may be arranged so that, when it is opened, it does not obstruct the flow channel, or so that it does not obstruct the flow channel to a degree sufficient to deflect the refrigerated air flowing along the channel.

The lower and at least one further door may be arranged such that only one door may be opened at any one time. This may be achieved by arranging the door which is open to block or restrict said other door from being opened. Alternatively it may be achieved by arranging a restraining member to restrict opening of one of the doors when the other is open. When the lower door is open the at least one further door may be restricted from being opened as will be shown in FIG. 8 where door 30 is blocked by door 24. This may promote the flow of air along a portion of the flow channel defined between the further door and the shelf and restrict loss of cooled air from the further part of the chamber. When the at least one further door is open the lower door may be restricted from being opened as will be shown in FIG. 9 where door 24 is blocked by door 30. This may promote the flow of air in the secondary flow path and restrict loss of cooled air from the lower part of the chamber.

The housing may have an opening having a width and a height, the opening providing access to the chamber. The opening may be in the front or rear of the housing. The at least one door may define at least part of the wall of the cabinet and may close the opening in the housing, when in its closed position. The lower door and the at least one further door may together define at least part of the wall of the cabinet and may close the opening in the housing, when in their closed positions. The at least one further door may extend across the full width of the opening. The at least one further door may extend across a full height of the opening.

The lower door and the at least one further door may each extend across the full width of the opening. The lower door and the at least one further door may each extend only part way across the opening in the height direction of the opening. The lower door may extend from a lower edge of the opening towards a top edge of the opening, and may only extend part of the way towards the upper edge. The at least one further door may extend from the lower door towards the upper edge of the opening, and may extend from the lower door to the upper edge of the opening. This may provide the advantage that, when the lower door is opened (and the at least one further door closed), a flow of refrigerated air along the flow channel is maintained. This is because only part of the chamber is open to the environment, along the height of the opening. This is in contrast to prior cabinets, where doors extend the full height of the opening and so refrigerated air is easily lost into the surrounding environment, and indeed warmer ambient air may more easily enter the chamber.

The lower door may be arranged such that it is moveable between a closed position and an open position, the lower door preventing opening of the at least one further door when in its open position. The lower door may be pivotally mounted to the housing. The lower door may be pivotable relative to the housing about pivot points which are positioned so that the door does not obstruct the flow channel when it is opened. The lower and/or at least one further door may be pivotable relative to or about a horizontal axis. The surface of the housing may be a front or rear surface.

The further door may be arranged so that it rests upon a top edge of the lower door when it is opened. The lower door may thereby support the further door when it is in the open position.

The at least one further door may be an upper door, the lower and the upper doors together defining at least part of the wall of the cabinet, which may be a front or rear wall. Alternatively, the cabinet may comprise at least two further doors, and may comprise: the lower door; an intermediate door positioned above the lower door and which can be opened to gain access to an intermediate part of the chamber; and an upper door positioned above the intermediate door and which can be opened to gain access to an upper part of the chamber.

The intermediate door may be arranged so that, when it is opened, it does not obstruct the flow channel, or so that it does not obstruct the flow channel to a degree sufficient to deflect the refrigerated air flowing along the channel. The upper door may be arranged so that, when it is open, the channel is obstructed and refrigerated air deflected to flow in the secondary flow path, around the lower and intermediate parts of the chamber.

Alternatively, the intermediate door may be arranged so that, when it is open, the channel is obstructed and refrigerated air deflected to flow in a secondary flow path around the lower part of the chamber. The upper door may be arranged so that, when it is open, the channel is obstructed and refrigerated air deflected to flow in a tertiary flow path around the lower and intermediate parts of the chamber.

Further intermediate doors may be provided if desired. It will be understood that each further door (and thus the intermediate and upper doors described above) may have any one of the features described elsewhere in this document. The lower, intermediate and upper doors may together define the wall of the cabinet, which may be a front or rear wall, and may close the opening defined by the housing.

The at least one shelf may be arranged so that, when the at least one further door is opened, air is deflected to flow from the flow channel along a lower surface of the shelf and around the lower part of the chamber. The at least one shelf may be positioned relative to the lower and at least one further door so that, when the at least one further door is opened, at least part of said door lies substantially parallel to the lower surface of the shelf and extends into the chamber aligning with the front or rear of the shelf. This promotes the flow of air around the lower part of the chamber; the shelf acts as a baffle to direct the flow of air. Where an additional door is provided, a shelf may be similarly located in relation to the additional door.

The cabinet may comprise at least two shelves and may comprise at least one shelf in the lower part of the chamber and at least one shelf in the further part of the chamber. A shelf may be provided in the further part of the chamber which defines a boundary between the lower and further parts of the chamber.

The doors may together define the wall of the cabinet and thus an outer boundary of the flow channel. The at least one shelf may have a display portion for supporting items to be displayed, and a non-display portion which may extend at least part way into the flow channel and which comprises at least one vent for the passage of refrigerated air along the flow channel. It will be understood that the flow channel may then be defined between the wall of the cabinet and an edge or boundary of the display portion of the shelf.

The doors and flow channel may be positioned at the front or rear of the cabinet. It is assumed here that the front of the cabinet is customer facing in normal operation. Where the doors are positioned to the front of the cabinet, the food or drink items may be viewed, selected and extracted by a customer for consumption or purchase. In this case, the cabinet may have a solid back for positioning against a wall or fixture, or it may have conventional doors for periodic loading. When the doors and flow channel are positioned to the rear of the cabinet, the food or drink items may be viewed and selected by a customer, but may be extracted by service staff working on the opposite side of the cabinet. In this case, the cabinet would normally have a transparent front for display quality.

At least one of the doors, in particular the lower door, may be slidably mounted relative to the housing and/or may comprise door portions which are slidably mounted relative to the housing and one another, for gaining access to the chamber.

The refrigeration system may comprise an air outlet for discharging refrigerated air into the chamber, and an air inlet for receiving air circulated around the chamber for re-cooling, the outlet positioned to direct air upwardly along the flow channel.

Reference is made herein to refrigerated air. It will be understood that such references are to air which has been cooled to a temperature which is below ambient air temperature in an environment in which the display cabinet is located.

DETAIL DESCRIPTION OF THE INVENTION

Embodiments of the present invention will now be described, by way of example only, with reference to the foregoing drawings. The foregoing drawings are not intended to define a cabinet which has specifically front or rear facing doors and it is assumed that the cabinet and thus the doors can face in either direction.

Figure 1:
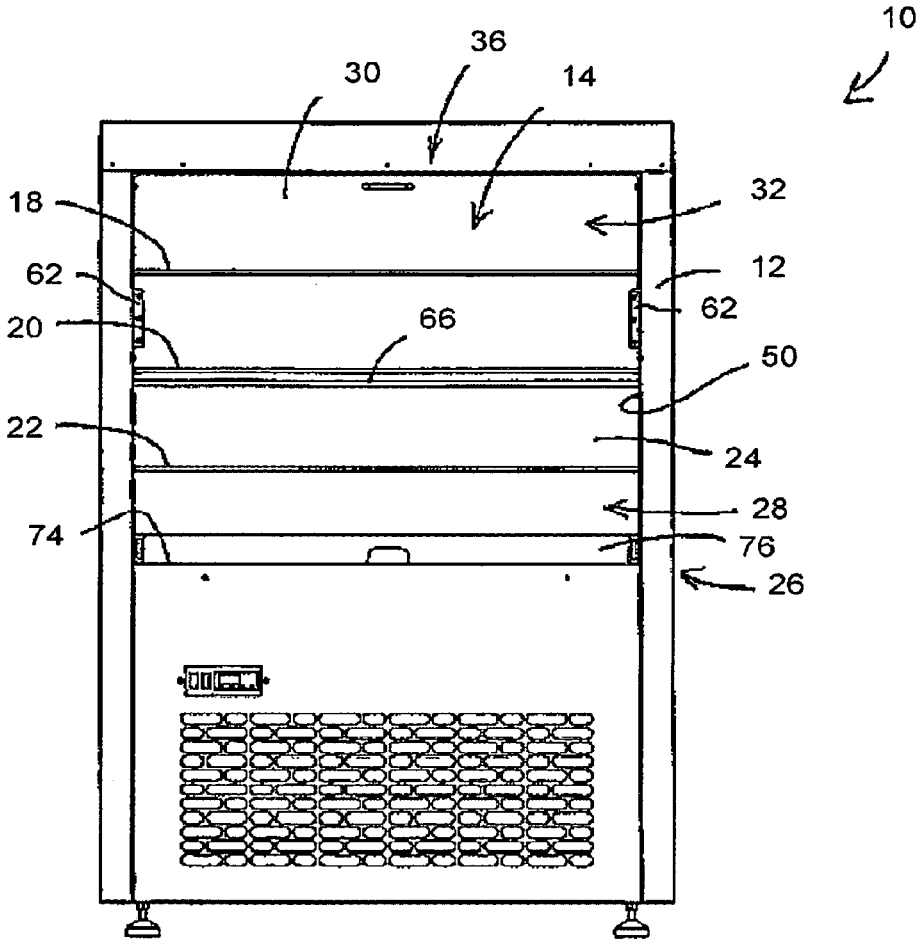
FIGS. 1 and 2 are elevation, and perspective views, respectively, of a refrigerated display cabinet in accordance with an embodiment of the present invention.
Figure 2:
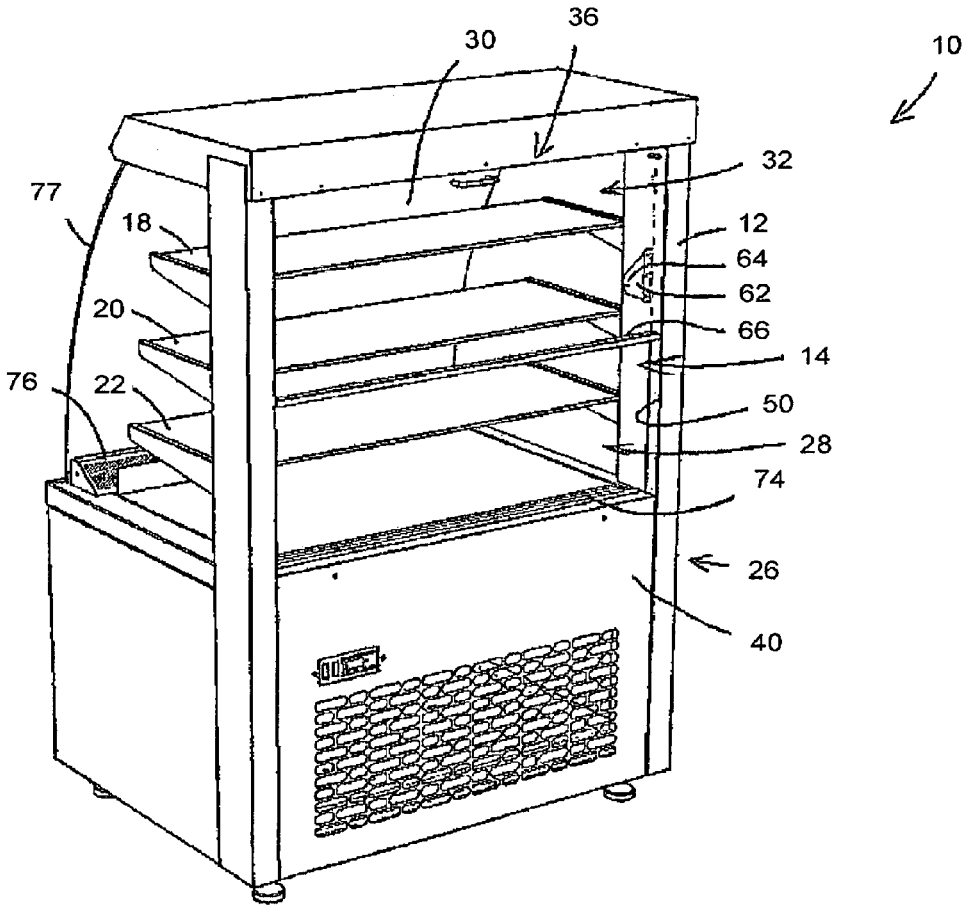
Figure 4:
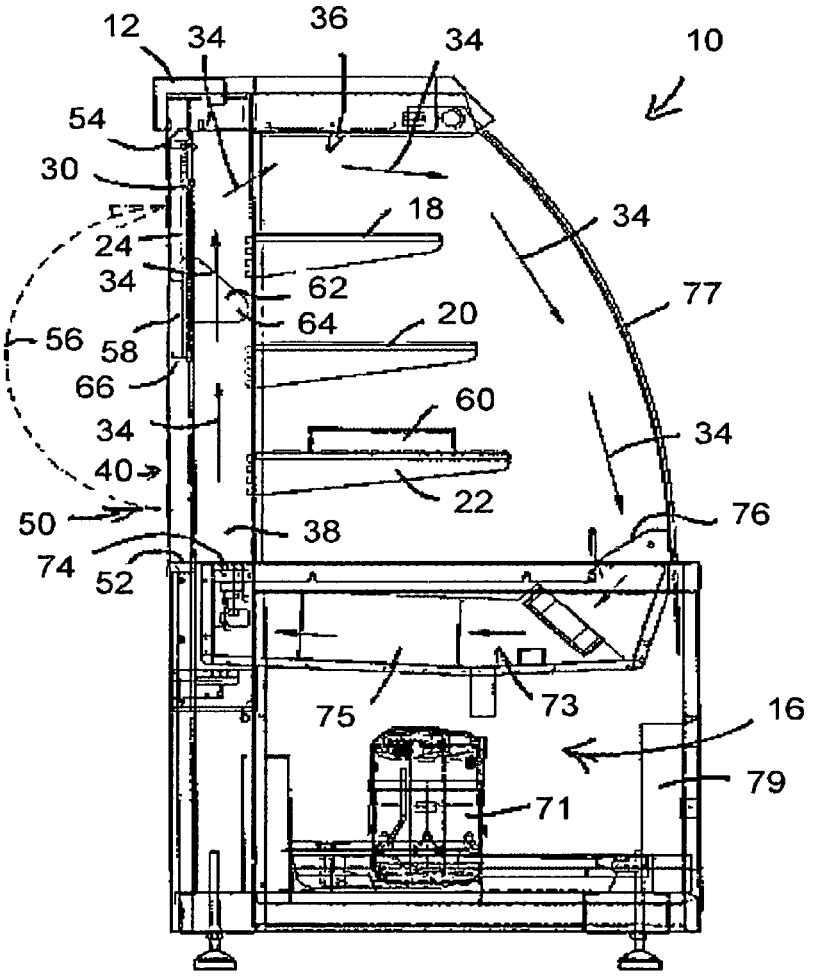
FIG. 4 and FIG. 8 are views similar to FIG. 3 showing the refrigerated display cabinet with the lower door open and the further door closed.
Figure 5:
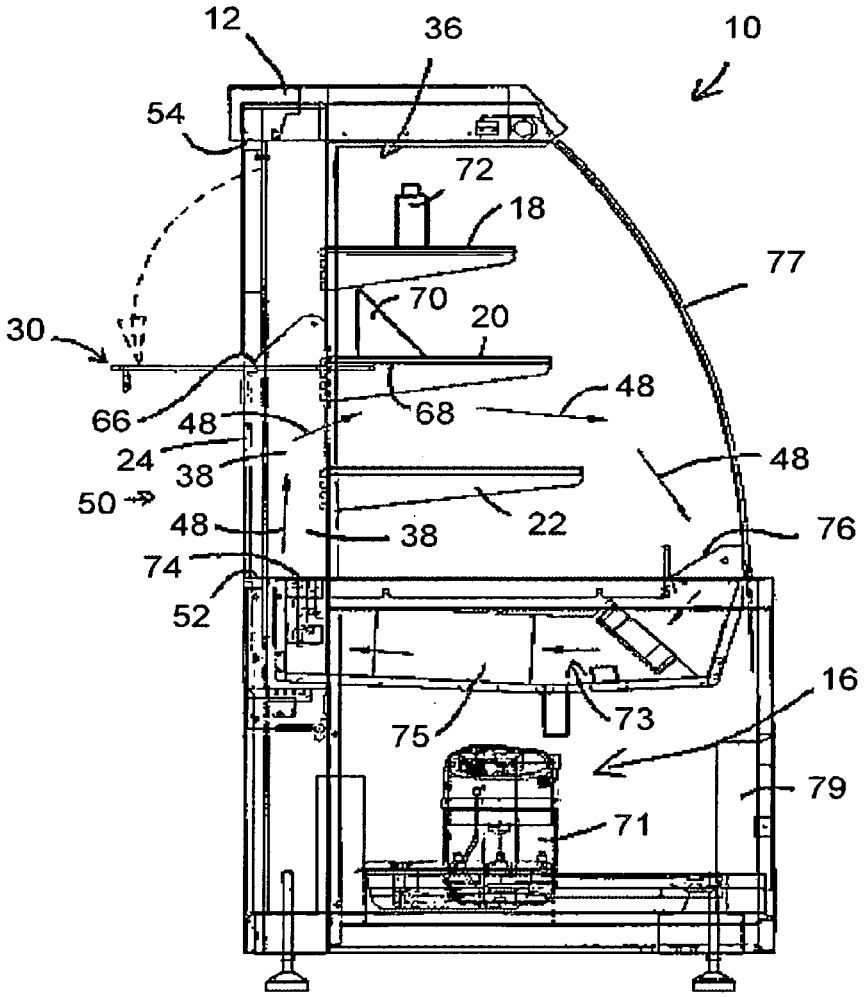
FIG. 5 and FIG. 9 are views similar to FIG. 3 showing the refrigerated display cabinet with the lower door closed and the further door open.

Turning firstly to FIGS. 1 and 2, there are shown elevation and perspective views, respectively, of a refrigerated display cabinet in accordance with an embodiment of the present invention, the cabinet indicated generally by reference numeral 10. The cabinet 10 is also shown in FIGS. 3, 4 and 5 which are schematic side views showing the cabinet in use.

The cabinet 10 generally comprises a housing 12 which defines a display chamber 14. The cabinet 10 also comprises a refrigeration system 16 (FIGS. 3 to 5), for circulating refrigerated air around the chamber 14. At least one shelf is mounted in the chamber 14, for receiving items to be displayed and, in the illustrated embodiment, the cabinet comprises three shelves 18, 20 and 22. A lower door 24 is provided to the front or rear face 26 of the cabinet 10. The lower door can be opened to gain access to a lower part 28 of the chamber 14. There is also at least one further door and, in the illustrated embodiment, one further door in the form of an upper door 30. The upper door 30 is again provided in the front or rear 26 of the cabinet 10, and is positioned above the lower door 24. The upper door 30 can be opened to gain access to an upper part 32 of the chamber 14.

Figure 3:
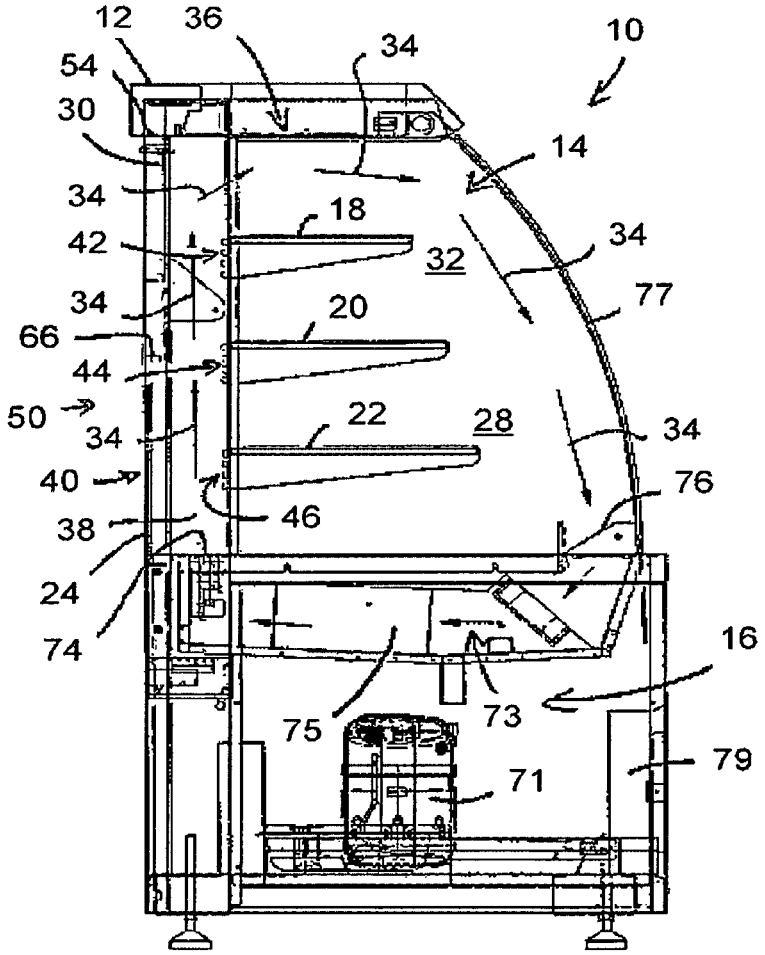
FIG. 3 is a schematic side view of the refrigerated display cabinet of FIGS. 1 and 2 shown in use, with lower and further doors of the cabinet closed.

FIG. 3 shows the cabinet 10 with both the lower door 24 and the upper door 30 closed. A primary flow path for refrigerated air is defined within the chamber 14, and is indicated generally by the arrows 34 in FIG. 3. The primary flow path extends upwardly, towards a top 36 of the chamber 14, along a channel 38 defined between door face 40 of the housing 12 and the adjacent edges of each of the shelves 18, 20 and 22, which are indicated by the reference numerals 42, 44 and 46 respectively. The door face 40 is defined by the lower door 24 and the upper door 30, when in their closed positions. FIG. 4 shows the cabinet 10 following opening of the lower door 24, and with the upper door 30 closed. FIG. 5 shows the cabinet 10 with the lower door 24 closed and the upper door 30 open.

The upper door 30 is arranged so that, when it is opened, the flow channel 38 is obstructed and refrigerated air deflected to flow in a secondary flow path around the lower part 28 of the chamber 14. Flow in the secondary flow path is indicated by the arrows 48 in FIG. 5. This arrangement provides numerous advantages over prior cabinets. In particular, when the upper door 30 is opened, and refrigerated air deflected to flow in the secondary flow path shown by the arrows 48, the cooled, refrigerated air is not lost to the surrounding environment. This provides an enhanced cooling effect of the air in the lower part 28 of the chamber 14 so that, when the upper door 30 is re-closed and the primary flow path re-established (FIG. 3), the air in the upper part 32 of the chamber 14 is quickly re-cooled to a desired level. The retention of refrigerated air in the lower part 28 of the chamber 14, and the quick re-cooling of the air in the upper chamber part 32, also helps to reduce energy usage and thus operating costs of the cabinet 10. Additionally, the cabinet 10 helps to maintain food or drink items stored in the chamber 14 at a sufficiently low temperature.

Further advantages of the cabinet 10 lie in the arrangement of the lower door 24 relative to the upper door 30, and the way in which the lower door is opened and closed. In particular and as discussed above, FIG. 4 shows the cabinet 10 with the upper door 30 closed and the lower door 24 open. The arrangement of the lower and upper doors 24, 30 in the cabinet 10 is such that, with the lower door 24 open, adequate flow of refrigerated air around the chamber 14 along the primary flow path is maintained. This is because the lower door 24 only extends part way across an opening 50 in the housing 12, between lower and upper edges 52 and 54 of the opening. The upper door 30 extends downwardly from the upper edge 54 towards the lower door 24, and this helps to maintain flow upwardly along the flow channel 38 and around the primary flow path in the chamber 14, when the lower door 24 is open. Accordingly, loss of refrigerated air from the chamber 14, and ingress of warmer ambient air, is restricted.

The cabinet 10 and its method of operation will now be described in more detail.

As shown in FIG. 1, each of the lower and upper doors 24, 30 extend across a full width of the opening 50 defined in the front or rear face 26 of the housing 12. The doors 24 and 30 together close the opening 50, when in their closed positions (FIG. 3). The doors may each comprise a single pane of a glass or plastics material, such as polycarbonate. However, in a variation on the illustrated embodiment, one or both of the doors 24 and 30 may comprise inner and outer panes with intermediate insulation gap (not shown). Other structures and materials may however be utilised.

In their closed positions, the lower and upper doors 24, 30 lie in vertical planes, and together define door face 40 of the cabinet 10. In effect, the doors 24 and 30 together define a boundary of the chamber 14. The lower door 24 is pivotally mounted to the housing 12 via pivot pins (not shown), so that it may pivot between the closed position shown in FIG. 3 and the open position shown in FIG. 4, as indicated by the arrow 56 in FIG. 4. The upper door 30 is recessed in the housing 12, so that the lower door 24 can be received within a recess 58 (FIG. 4) when it is pivoted to the open position. With the lower door 24 open, access can be gained to the lower part 28 of the chamber 14, for example to place a food or drink item 60 on the shelf 22, or to extract the food or drink item from the chamber. The lower door 24 is arranged such that, when it is open, it does not obstruct the flow channel 38. Accordingly, during this time, refrigerated air continues to flow in the primary flow path, as indicated by the arrows 34. A portion of the refrigerated air may escape to the surrounding environment, but this is significantly reduced compared with prior cabinets. Once the desired action has been carried out, the lower door 24 is pivoted back to the closed position (FIG. 3).

The upper door 30 provides access to both of the shelves 18 and 20, for the insertion or extraction of a food or drink item 70, 72 from the respective shelf. The upper door 30 is similarly pivotally mounted to the housing 12, by means of mounting brackets 62 and pivot pins 64. The pivot pins 64 are positioned relative to the upper door 30 in such a way that, as the door moves from the closed position of FIG. 4 to the open position of FIG. 5, the door bridges across and obstructs the flow channel 38. The upper door 30 is also positioned so that, when in the open position, the door lies parallel with the shelf 20 and is closely adjacent to a lower surface 68 of the shelf. In this way, the shelf 20 acts as a baffle to promote the flow of refrigerated air in the secondary flow path, indicated by the arrows 48. Arranging the door 30 to be positioned closely adjacent to the shelf 20 also helps to prevent back-flow of air into the flow channel 38 above the shelf. Typically, a gap of about 5 mm to about 10 mm may exist between the door 30 and the lower surface 68 of the shelf 20.

The lower and upper doors 24 and 30 are arranged such that, when the upper door 30 is pivoted to the open position, it rests upon a top edge surface 66 of the lower door 24. In this way, the lower door 24 stays the movement of the upper door 30, and supports the upper door during the time when it is open. It will be understood however that the upper door may be stayed/supported in other ways. For example, the upper door 30 may contact the lower surface 68 of the shelf 20. Restraints may be provided on the housing 12 and/or mountings 62 which cooperate to support and stay movement of the door 30. The upper door 30 may also be of a toughened material, so that the door is suitable for supporting items which are being inserted into or extracted from the chamber 14. The door 30 may therefore act as a temporary shelf for supporting a food or drink items. The door 30 may also have a spring compensation to cause it to return to the closed position.

The refrigeration system 16 is designed for circulating air around the entire volume of the chamber 14, and so promoting air flow in the secondary flow path provides an enhanced cooling effect of the air in the lower part 28 of the chamber 14. In this way, when the upper door 30 is re-closed (FIG. 4), so that the primary flow path is re-established, the air in the lower part 28 of the chamber 14 is circulated into the upper part 32 of the chamber. This air, which is at an enhanced lower temperature, helps to mitigate the loss of circulation of refrigerated air in the upper part 32 of the chamber 14 whilst the door 30 is open, and also the entry of warmer ambient air.

The refrigeration system 16 is similar to that provided in prior cabinets, and may include a compressor 71, an expansion device (not shown), an evaporator 75, ducting 73 and a condenser 79. The ducting 73 includes an outlet 74 and an inlet 76 (best shown in FIG. 2), both of which open on to the chamber 14. Refrigerated air is directed along the ducting 73 and into the chamber 14 through the outlet 74. The outlet 74 is located so as to promote the flow of refrigerated air upwardly along the flow channel 38 towards the top 36 of the display chamber 14. Some of the air will circulate across the shelves 18, 20 and 22, but a main portion of the air flows to the chamber top 36 and back down along panel 77 which may be a clear viewing screen or an insulated wall depending upon the configuration of the cabinet 10. Panel 77 may be curved or may be substantially vertical and may be constructed of plastic or metal skins with intermediate insulation, comprising a box to which doors 30 and 24 are the only form of access. The inlet 76 receives air which has circulated around the chamber 14 for direction along the ducting 73 back to the evaporator 75, for subsequent re-cooling and re-circulation into the chamber 14.

Variations on the structure of the cabinet 10 are possible. For example and turning now to FIG. 6, there is shown a refrigerated display cabinet in accordance with another embodiment of the present invention, the cabinet indicated generally by reference numeral 10*a*. Like components of the cabinet 10*a* with the cabinet 10 shown in FIGS. 1 to 5 share the same reference numerals, with the addition of the suffix "a". Only the substantial differences between the cabinet 10*a* and the cabinet 10 will be described herein in detail.

The cabinet 10*a* includes additional shelves and doors. In more detail, the cabinet 10*a* has a housing 12*a* defining a display chamber 14*a*. Five shelves 18*a*, 20*a*, 22*a*, 78 and 80 are mounted in the chamber 14*a*. The cabinet 10*a* also has a lower door 24*a*, an upper door 30*a* and an intermediate door 82. The intermediate door 82 is positioned above the lower door 24*a*, and the upper door 30*a* is positioned above the intermediate door 82. The lower door 24*a* facilitates access to a lower part 28*a* of the chamber 14*a* and thus to the shelf 80. The intermediate door 82 facilitates access to an intermediate part 84 of the chamber 14*a* and thus to the shelves 22*a* and 78. The upper door 30*a* facilitates access to an upper part 32*a* of the chamber 14*a* and thus to the shelves 18*a* and 20*a*. The intermediate door 82 and upper door 30*a* are each of similar construction and operation to the door 30 of the cabinet 10 described above. Additionally, the intermediate door 82 may be arranged so that it supports the upper door 30 when it is open.

With all of the doors 24*a*, 82 and 30*a* closed, refrigerated air flows in a primary flow path around the internal chamber 14*a*, as indicated by the arrows 34*a*. When the lower door 24*a* is opened, a majority of the refrigerated air continues to flow in the primary flow path, which extends upwardly from an outlet 74*a* of a refrigeration system 16*a* along a flow channel 38*a* towards a top 36*a* of the chamber 14*a*.

When the intermediate door 82 is opened, it obstructs the flow channel 38*a*, and deflects the refrigerated air to flow in a secondary flow path around the lower part 28 of the chamber 14*a*, as indicated by the arrows 48*a*. In the open position, the intermediate door 82 lies adjacent a lower surface 86 of the shelf 78, which acts as a baffle. When the door 82 is re-closed, the air which has flowed around the secondary flow path is once again directed upwardly along the flow channel 38*a* towards the top 36*a* of the chamber 14*a*, re-cooling air in the upper and intermediate parts 38*a* and 84 of the chamber 14*a*.

When the upper door 30*a* is opened, it obstructs the flow channel 38*a* so that refrigerated air is deflected to flow in a tertiary flow path around the intermediate and lower parts 84 and 28*a* of the chamber 14*a*. This is indicated by the arrows 88. The upper door 38*a* resides adjacent the lower surface 68*a* of the shelf 20*a* when it is open, and the shelf 20*a* acts as a baffle to direct the air flow. When the upper door 30*a* is re-closed, refrigerated air which has flowed around the tertiary flow path is once again directed up the flow channel 38*a* towards the top 36*a* of the chamber 14*a*, re-cooling air in the upper part 38*a* of the chamber 14*a*.

Figure 6:
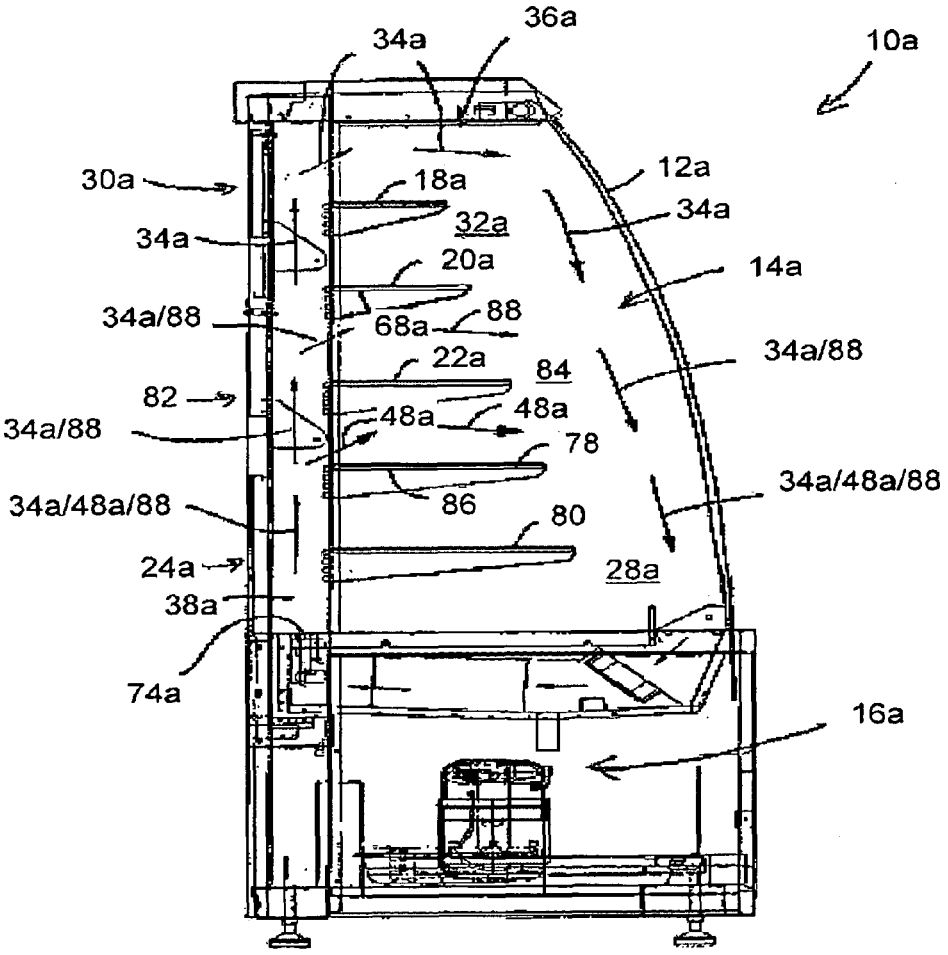
FIG. 6 and FIG. 7 are schematic side views of a refrigerated display cabinet in accordance with further embodiments of the present invention, shown in use and with lower, intermediate and upper doors closed.
Figure 7:
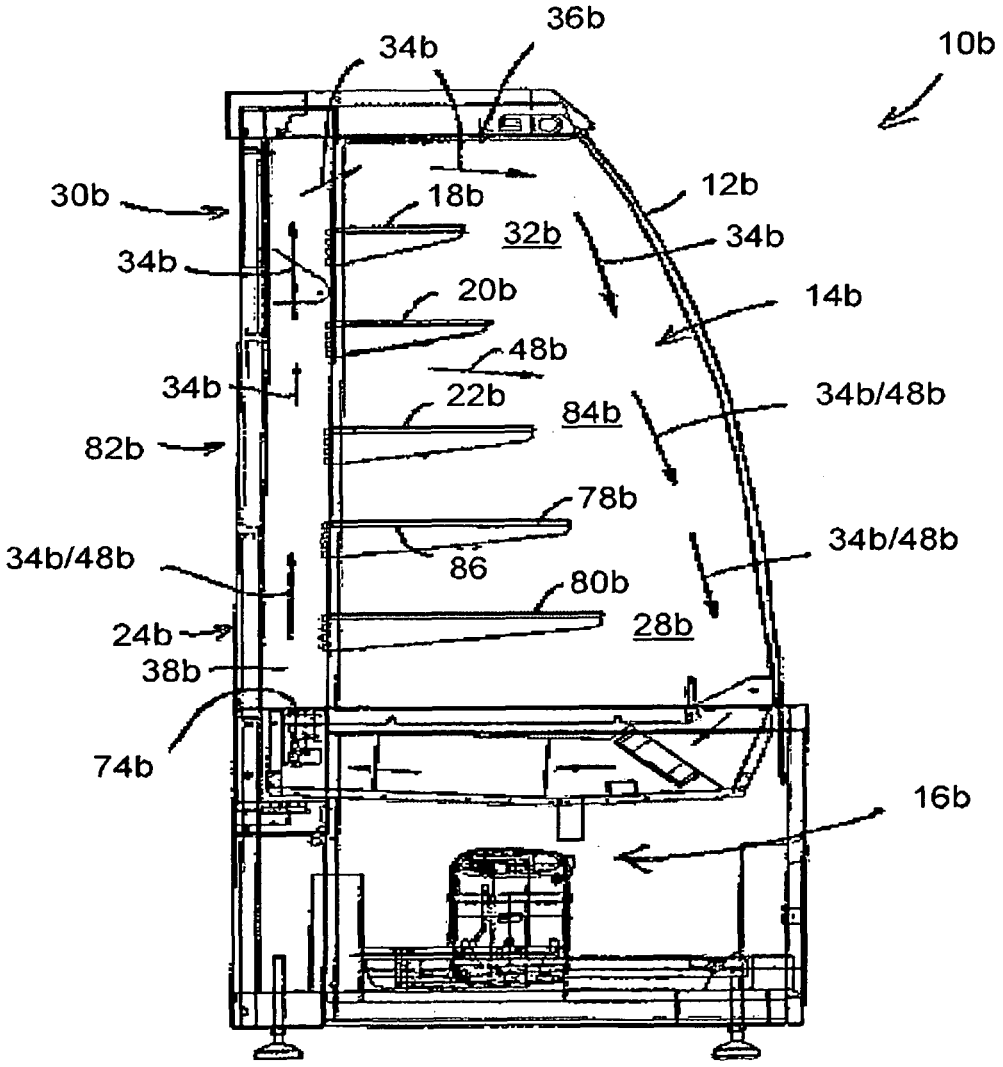
Figure 8:
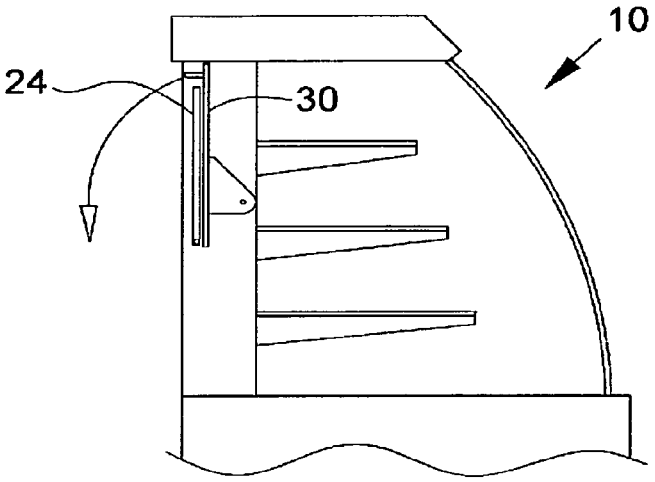
Figure 9:
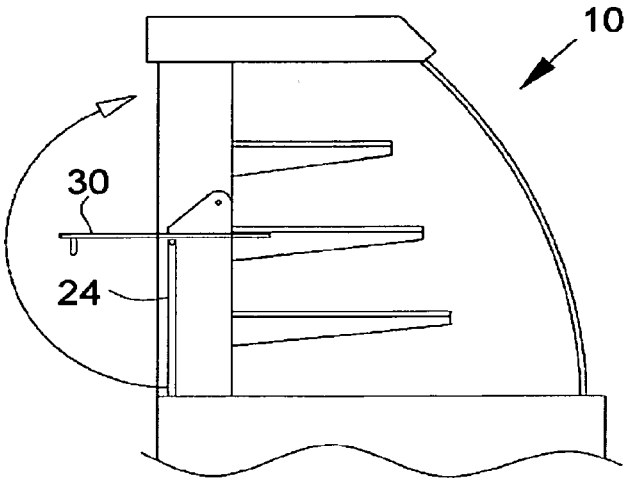

FIG. 7 shows a refrigerated display cabinet in accordance with another embodiment of the present invention, the cabinet indicated generally by reference numeral 10*b*. Like components of the cabinet 10*b* with the cabinet 10 shown in FIGS. 1 to 5 share the same reference numerals, with the addition of the suffix "b". Like components of the cabinet 10*b* with the cabinet 10*a* shown in FIG. 6 share the same reference numerals, with the suffix "a" replaced by the suffix "b". Only the substantial differences between the cabinets will be described herein in detail.

As with the cabinet 10*a* shown in FIG. 6, the cabinet 10*b* has five shelves 18*b*, 20*b*, 22*b*, 78*b* and 80*b* mounted in a chamber 14*b*. The cabinet 10*b* also has a lower door 24*b*, an upper door 30*b* and an intermediate door 82*b*. In this instance, the lower and intermediate doors 24*b* and 82*b* are each of similar construction and operation to the lower door 24 of the cabinet 10 shown in FIGS. 1 to 5.

With all of the doors 24*b*, 82*b* and 30*b* closed, refrigerated air flows in a primary flow path around the internal chamber 14*b*, as indicated by the arrows 34*b*. When the lower or intermediate doors 24*b* or 82*b* are opened, a majority of the refrigerated air continues to flow in the primary flow path.

When the upper door 30*b* is opened, it obstructs flow channel 38*b*, and deflects the refrigerated air to flow in a secondary flow path around lower and intermediate parts 28*b* and 84*b* of the chamber 14*b*, as indicated by the arrows 48*b*. When the door 30*b* is re-closed, the air which has flowed around the secondary flow path is once again directed upwardly along the flow channel 38*b* towards a top 36*b* of the chamber 14*b*, re-cooling air in the upper part 32*b* of the chamber.

Various modifications may be made to the foregoing without departing from the spirit or scope of the present invention. For example. an inverted embodiment of the cabinet where evaporator 75 would be positioned above the display chamber would effectively reverse the terms: 'upper': 'lower': 'upwardly': and 'top' without any departure from the scope of the invention.

Figure 10:
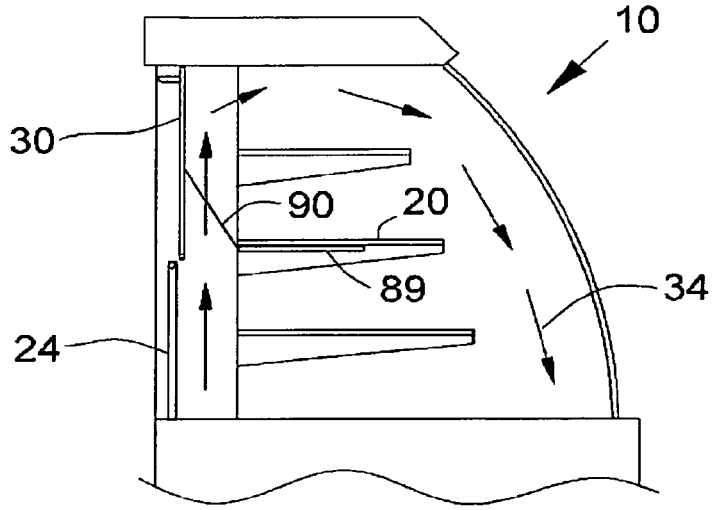
FIG. 10.
Figure 11:
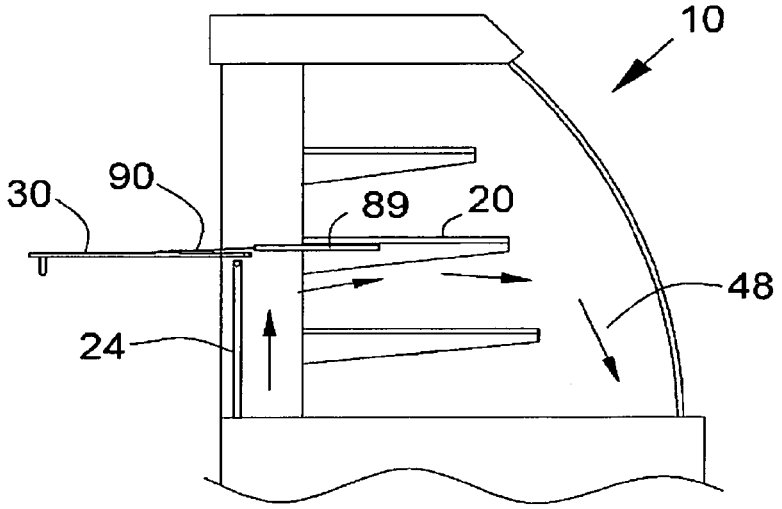
FIG. 11.

For example, the at least one door may be operatively associated with a further component of the cabinet so that, when said door is opened, the further component is caused to obstruct the flow channel. The further component may be moveable from a position where it does not obstruct the flow channel, to a position where it obstructs the flow channel, when the at least one door is opened. The further component may be a shelf or part of a shelf, which may be moveably mounted to the housing within the chamber so as to move to a position where it obstructs the flow channel when the at least one door is opened. The further component may be a barrier member which is moveably mounted to the housing within the chamber. FIG. 10 shows Barrier member 89 which comprises of a solid strip incorporating linkage rods 90 and is slidably mounted under shelf 20 and also connected, by linkage rods 90. to door 30. FIG. 10 shows primary air flow 34 circulating throughout the entire chamber. FIG. 11 shows that when door 30 is moved into the open position. the barrier member 89 is pulled outward from shelf 20 so that it obstructs the flow channel deflecting air into secondary flow path 48. When door 30 is moved back to the closed position, barrier member 89 is pushed back under shelf 20 so that the flow channel is once again open due to the negligible thickness of linkage rods 90.

Linkage rods 90 attach to barrier member 89 and door 94 allowing for the relative pivotal movement which would occur during door opening.

Figure 12:
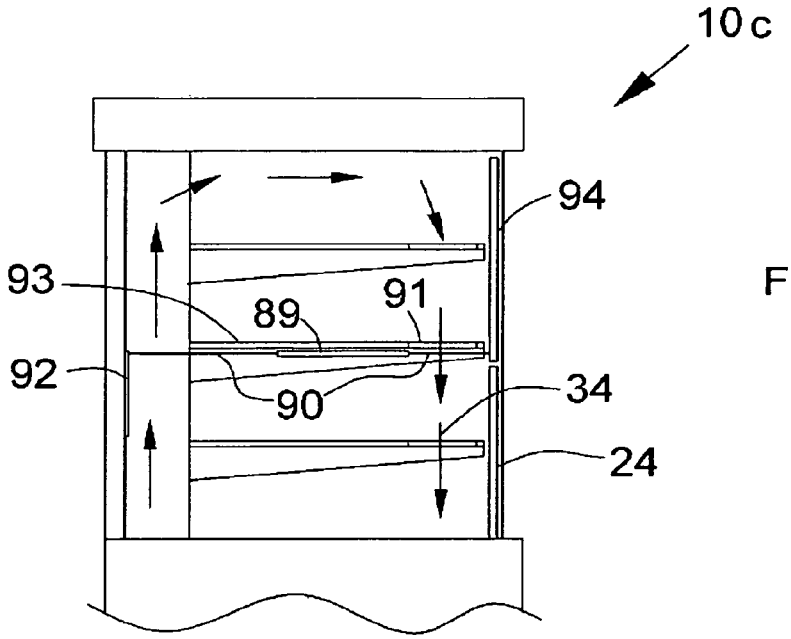
FIG. 12 and FIG. 13 are schematic side views of a refrigerated display cabinet in accordance with further embodiments of the present invention, shown in use with barrier members.
Figure 13:
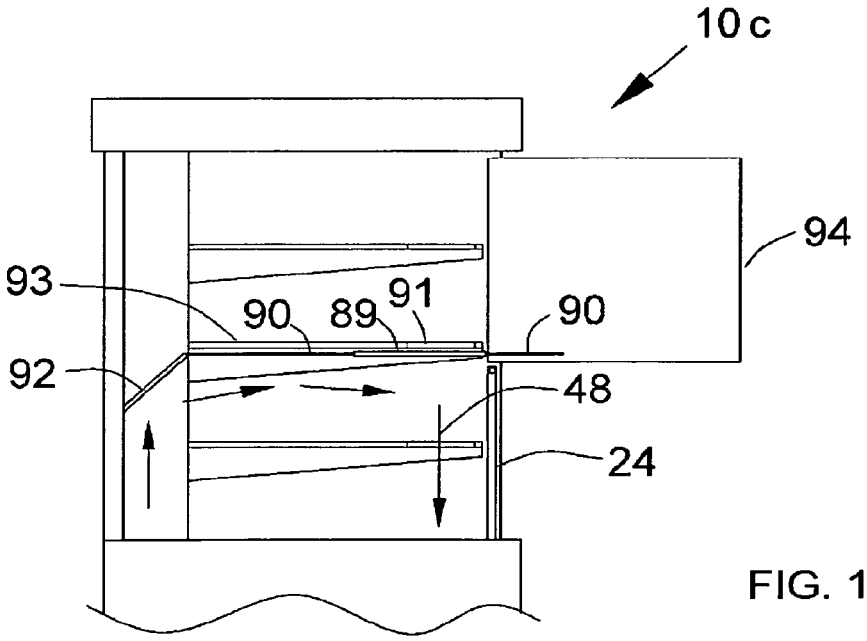

As shown in FIG. 12. cabinet 10c comprises the at least one shelf 93 which may have a display portion for supporting items to be displayed, and a non-display portion which may extend at least part way into the flow channel and which comprises at least one vent or aperture a for the passage of refrigerated air in primary flow path 34. It will be understood that the flow channel may then be defined between the wall of the cabinet and an edge or boundary of the display portion of the shelf or by the edges of the aperture in the shelf. Barrier member 89 comprises of a solid strip incorporating linkage rods 90 and is slidably mounted under shelf 93 and also connected. by linkage rods 90. to door 94 at one side and to barrier member flap 92 at the other side. FIG. 13 shows that. when door 94 is opened. linkage rods 90 pull barrier member 89 and barrier member flap 92 forwards so as to deflect the air into secondary flow oath 48. FIG. 11 and FIG. 13 illustrate that the Door may pivot on either a horizontal or vertical axis when combined with barrier member 89.

The at least one door may be provided in either the front or rear of the cabinet, and the opposing wall of the cabinet may comprise an insulated panel, or a transparent screen through which items can be viewed. The opposing wall may be fixed, or may be openable so as to gain access to the chamber for loading or extracting food or drink items.

Where there are a plurality of doors, at least one of the doors, may be adapted to slide vertically relative to the housing and/or may comprise door portions which are slidably mounted relative to the housing and one another, for gaining access to the chamber. In this case, the upper door may include a horizontal deflector portion which obstructs the flow channel as it slides into alignment with a shelf.

The principles underlying the present invention may be applied to refrigerated display cabinets of other types, such as types with remote condensing refrigeration systems.

What is claimed is:

1. A refrigerated display cabinet comprising:

a housing defining a display chamber;

a refrigeration system for circulating refrigerated air within the display chamber;

at least one shelf mounted in the chamber for receiving items to be displayed; and at least one door which, when closed, serves to isolate the air within the display chamber from the external ambient air and which can be opened to gain access to the chamber from outside the cabinet;

wherein refrigerated air from said refrigeration system moves within the display chamber, directly contacting and chilling the display items;

and wherein a primary flow path for refrigerated air is defined within the chamber, the primary flow path extending around the interior of the chamber through a channel defined by at least one aperture adjacent to or within and the at least one shelf;

and wherein, opening the at least one door obstructs the channel and causes refrigerated air to be deflected to flow in a secondary flow path around a lower part of the chamber and around said refrigeration system;

and wherein, the at least one shelf additionally serves to isolate the refrigerated air in the secondary flow path from the external ambient air when the at least one door is open, and wherein the lower part of the chamber defined by the secondary flow path is of a lesser volume than the entire chamber.

2. The cabinet as claimed in claim 1, wherein the cabinet comprises:

a lower door which, when closed, serves to isolate the air within the display chamber from the external ambient air and which can be opened to gain access from outside the cabinet to a lower part of the chamber; and an upper door, positioned above the lower door, which when closed, serves to isolate the air within the display chamber from the external ambient air and which can be opened to gain access from outside the cabinet to an upper part of the chamber;

and wherein opening the upper door obstructs the channel and causes refrigerated air to be deflected to flow in the secondary flow path around the lower part of the chamber.

3. The cabinet as claimed in claim 2, wherein, the lower door and the upper door comprise one face of the cabinet and, wherein an opposite face of the cabinet comprises of a transparent material which facilitates display of the cabinet contents.

4. The cabinet as claimed in claim 2, wherein the cabinet is constructed as an insulated box, and wherein the lower door and the upper door comprise the only access openings into the cabinet.

5. The cabinet as claimed in claim 2, wherein the upper door is in an open position so that external ambient air is admitted to the upper part of the chamber and wherein the secondary flow path is then defined and enclosed by:

a portion of the upper door in the open position, and;

the underside of the at least one shelf which acts as an air-resistant baffle between the upper and lower parts of the chamber and;

a vertical door surface below the at least one shelf;

and wherein, the portion of the upper door rests in close proximity with an edge of the at least one shelf and also rests in close proximity with the vertical door surface below the at least one shelf, thereupon obstructing and closing the primary flow path, thereupon deflecting air along the underside of the at least one shelf thereupon excluding external air from entering the lower part of the chamber.

6. The cabinet as claimed in claim 2, wherein the housing has an opening having a width and a height, the continuous opening providing access to the chamber, and wherein the lower door and the upper door each extend across the full width of the opening.

7. The cabinet as claimed in claim 6, wherein;

the lower door extends from a lower edge of the opening part of the way towards a top edge of the opening;

and wherein, the upper door extends from the lower door to the upper edge of the opening.

8. The cabinet as claimed in claim 2, wherein the cabinet comprises at least one intermediate door, and includes:

the lower door which when closed serves to isolate the air within the display chamber from the external ambient air and which can be opened to gain access to the chamber from outside the cabinet;

the intermediate door positioned above the lower door which when closed, serves to isolate the air within the display chamber from the external ambient air and which can be opened to gain access to an intermediate part of the chamber from outside the cabinet; and the upper door positioned above the intermediate door which, when closed, serves to isolate the air within the display chamber from the external ambient air and which can be opened to gain access to an upper part of the chamber from outside the cabinet;

and wherein, when the intermediate door is moved into the open position, no portion of the intermediate door projects into the flow channel;

and wherein opening the upper door obstructs the channel and causes refrigerated air to be deflected to flow in the secondary flow path around the lower part of the chamber.

9. The cabinet as claimed in claim 2, wherein the cabinet comprises at least one intermediate door, and includes:

the lower door which, when closed, serves to isolate the air within the display chamber from the external ambient air and which can be opened to gain access to the chamber from outside the cabinet;

the intermediate door positioned above the lower door which, when closed, serves to isolate the air within the display chamber from the external ambient air and which can be opened to gain access to an intermediate part of the chamber from outside the cabinet; and the upper door positioned above the intermediate door which when closed, serves to isolate the air within the display chamber from the external ambient air and which can be opened to gain access to an upper part of the chamber from outside the cabinet;

and wherein opening the upper door obstructs the channel and causes refrigerated air to be deflected to flow in the secondary flow path around the lower part of the chamber;

and wherein, opening the intermediate door obstructs the channel and causes refrigerated air to be deflected to flow in a tertiary flow path around a lower part of the chamber.

10. The cabinet as claimed in claim 2, wherein;

the upper door may be opened, at which point external air may be admitted into the upper part of the chamber or the lower door may be opened at which point external air may be admitted into the lower part of the chamber, and wherein, when the upper or lower door is opened, the at least one shelf comprises a boundary or part of a boundary which serves to prevent the exchange of air between the upper part of the chamber and the lower part of the chamber.

11. The cabinet as claimed in claim 2, wherein the lower door and the upper door are movable between open and closed positions by way of pivotal mountings whereupon the pivot axes are horizontal.

12. The cabinet as claimed in claim 11, wherein the upper door pivots into an open position in which position the upper door thereupon blocks the path of the lower door, preventing the lower door from travelling pivotally towards an open position.

13. A The cabinet as claimed in claim 11, wherein the lower door pivots into an open position in which position the lower door thereupon blocks the path of the upper door, preventing the upper door from travelling pivotally towards an open position.

14. The cabinet as claimed in claim 11, wherein a portion of the upper door extends beyond the pivot axis such that the portion of the upper door rotates into the flow channel and obstructs the flow channel when the upper door is moved into the open position.

15. The cabinet as claimed in claim 11, wherein the pivot axis of the lower door is positioned along one of the horizontal edges of the lower door, wherein when the lower door rotates into the open position, no portion of the lower door projects into the flow channel.

16. The cabinet as claimed in claim 1, wherein the movement of the at least one door drives a barrier member so that, when said door is opened, the barrier member is accordingly moved to obstruct the flow channel.

* * * * *